US009658020B2

(12) United States Patent
Daniel et al.

(10) Patent No.: US 9,658,020 B2
(45) Date of Patent: May 23, 2017

(54) SYSTEMS AND METHODS FOR MOUNTING BARRELS TO FIREARMS

(71) Applicant: Daniel Defense, Inc., Black Creek, GA (US)

(72) Inventors: Marvin C. Daniel, Pooler, GA (US); Clinton Wade Lynch, Irmo, SC (US)

(73) Assignee: Daniel Defense, Inc., Black Creek, GA (US)

( * ) Notice: Subject to any disclaimer, the term of this patent is extended or adjusted under 35 U.S.C. 154(b) by 0 days.

(21) Appl. No.: 14/745,843

(22) Filed: Jun. 22, 2015

(65) Prior Publication Data

US 2015/0369555 A1 Dec. 24, 2015

Related U.S. Application Data

(60) Provisional application No. 62/016,402, filed on Jun. 24, 2014.

(51) Int. Cl.
*F41A 21/48* (2006.01)
*F41C 23/16* (2006.01)

(52) U.S. Cl.
CPC ..... *F41A 21/485* (2013.01); *F41A 21/487* (2013.01); *F41C 23/16* (2013.01); *Y10T 29/49828* (2015.01); *Y10T 29/49964* (2015.01)

(58) Field of Classification Search
CPC ..... F41A 21/00; F41A 21/48–21/487; F41C 23/16
USPC ..... 42/75.01–75.02, 76.01; 89/14.05
See application file for complete search history.

(56) References Cited

U.S. PATENT DOCUMENTS 2,450,064 A * 9/1948 Wernli ..... F41A 21/482 285/406
3,318,192 A 5/1967 Miller et al.
5,020,260 A * 6/1991 Houghton ..... F41A 21/481 42/75.01
6,470,616 B1 * 10/2002 Clay ..... F41A 11/00 42/75.01
6,792,711 B2 * 9/2004 Battaglia ..... F41G 11/003 42/114
7,716,865 B2 * 5/2010 Daniel ..... F41C 23/16 42/75.01
8,051,595 B2 * 11/2011 Hochstrate ..... F41A 5/18 42/75.01
8,069,604 B2 12/2011 Larue
(Continued)

OTHER PUBLICATIONS

F&D Defense gun photographs, http://fd-defense.com/, Dec. 4, 2012, 4 pages.

(Continued)

*Primary Examiner* — Stephen M Johnson
*Assistant Examiner* — Benjamin Gomberg
(74) *Attorney, Agent, or Firm* — Merchant & Gould

(57) ABSTRACT

Systems and methods for mounting a barrel to a firearm are disclosed herein. The firearm may include a barrel, an upper receiver, a hand guard assembly, a lower receiver, a pistol grip, a buttstock, and a trigger. A barrel extension may include internal threads, mounting protrusions, mounting apertures, an elongated front barrel extension portion, an elongated rear barrel extension portion, and a barrel extension mounting flange. The barrel extension may be sandwiched and secured in between the upper receiver and the hand guard assembly via clamping screws.

12 Claims, 8 Drawing Sheets

(56) References Cited

U.S. PATENT DOCUMENTS

| | | | | |
|---|---|---|---|---|
| 8,087,194 | B1 | 1/2012 | Vuksanovich | |
| 8,505,227 | B2 | 8/2013 | Barrett et al. | |
| 8,539,708 | B2 | 9/2013 | Kenney et al. | |
| 8,595,970 | B2 * | 12/2013 | Picciotta | F41C 23/16 29/525.01 |
| 8,713,838 | B2 * | 5/2014 | Ubl | F41A 11/02 42/71.01 |
| 8,726,560 | B2 | 5/2014 | Overstreet et al. | |
| 8,769,853 | B1 * | 7/2014 | LaRue | F41C 23/16 42/71.01 |
| 8,782,943 | B2 | 7/2014 | Jarboe | |
| 8,839,545 | B1 * | 9/2014 | Gangl | F41A 11/00 42/75.03 |
| 8,931,196 | B1 * | 1/2015 | Larue | F41A 11/04 42/71.01 |
| 9,140,506 | B2 * | 9/2015 | Gomez | F41C 23/16 |
| 2010/0175290 | A1 * | 7/2010 | Duplessis | F41A 3/22 42/16 |
| 2010/0319231 | A1 * | 12/2010 | Stone | F41C 23/16 42/71.01 |
| 2011/0119981 | A1 * | 5/2011 | Larue | F41C 23/16 42/71.01 |
| 2013/0097910 | A1 * | 4/2013 | Daniel | F41C 23/16 42/72 |
| 2013/0180151 | A1 | 7/2013 | Moore | |

OTHER PUBLICATIONS

F&D Defense gun photograph, http://fd-defense.com/index.php/fd308-gallery, Jan. 24, 2013, 1 page.

* cited by examiner

SYSTEMS AND METHODS FOR MOUNTING BARRELS TO FIREARMS

CROSS-REFERENCE TO RELATED APPLICATION

This application claims priority to U.S. Provisional Patent Application No. 62/016,402, filed on Jun. 24, 2014, which is entirely incorporated herein by reference.

FIELD OF THE DISCLOSURE

The disclosure generally relates to firearms and more particularly relates to systems and methods for mounting barrels to firearms.

BACKGROUND

Semi-automatic and automatic firearms typically utilize firearm barrel extensions. A firearm barrel extension is a metal projection fixed to the rear of a firearm barrel which extends rearward from the chamber end and holds the breech locked against the gas pressure in the chamber of a firearm when fired. A barrel is threaded into a firearm barrel extension, in combination with a gas block and a gas tube, to create a barrel assembly. Typically, a firearm utilizes a barrel nut to connect the barrel assembly to the upper receiver of the firearm. The standard for attaching a barrel assembly to a firearm is for the barrel assembly to be secured into place by sliding the barrel nut over the barrel extension and thereafter locking the barrel assembly into place with the upper receiver, utilizing an oversized threaded segment. A hand guard assembly is then typically affixed to the barrel nut and the barrel assembly. Standard firearm barrel extensions are short in length and limited in overall diameter and generally do not provide sufficient rigidity or support of the barrel in the receiver.

Current methods of attaching barrel assemblies and/or hand guards to the upper receiver of a firearm, utilizing standard barrel extensions, are limited. Specifically, the overall length and diameter of standard barrel extensions result in a reduced surface mating area with the receiver and exhibit a less than favorable means of connection, unstable connection rigidity, and less than optimal chamber support. As such, it is desirable to have systems and methods for mounting barrels to firearms that increase the stability of the barrel extension and receiver connection by providing a greater support surface area.

SUMMARY

Some or all of the above needs and/or problems may be addressed by certain embodiments of the systems and methods for mounting a barrel to a firearm disclosed herein. According to an embodiment, the firearm may include a barrel, an upper receiver, and a hand guard. A barrel mounting system may include an elongated threaded barrel extension with mounting apertures, a modified upper receiver with threaded receiving mounting apertures, and a hand guard with mounting apertures and large clamping screws. Additionally, the first end of the upper receiver may include receiving apertures.

In other aspects, the present disclosure relates to a barrel mounting system for a firearm. The firearm includes a barrel, an upper receiver and a rail system. The barrel mounting system includes an upper receiver mounting portion disposed distally upon the firearm upper receiver, a hand guard assembly mounting portion disposed proximally on the firearm rail system and a firearm barrel extension providing a greater surface area for interconnecting the barrel, the upper receiver and the hand guard assembly of the firearm. The firearm barrel extension includes an elongated rear barrel extension section, an elongated front barrel extension section having internal threads therein for securement to the barrel and a barrel extension mounting flange disposed on the firearm barrel extension between the elongated rear barrel extension section and the elongated front barrel extension section. The barrel extension mounting flange includes exteriorly thereon a plurality of barrel extension mounting protrusions disposed in radially spaced array. Each barrel extension mounting protrusion includes a mounting aperture disposed therein for receiving a threaded mounting screw to join thereby the upper receiver mounting portion and the hand guard assembly mounting portion.

In further aspects, the present disclosure relates to a firearm barrel extension with a greater surface area for connecting an upper receiver of a firearm to a firearm barrel. The firearm barrel extension includes an elongated rear barrel extension section, an elongated front barrel extension section having internal threads therein for securement to the barrel and a barrel extension mounting flange disposed on the firearm barrel extension between the elongated rear barrel extension section and the elongated front barrel extension section. The barrel extension mounting flange includes exteriorly thereon a plurality of barrel extension mounting protrusions disposed in a radially spaced array. Each barrel extension mounting protrusion includes a mounting aperture disposed therein for receiving a threaded mounting screw to join thereby the upper receiver mounting portion and the rail system mounting portion.

In still further aspects, the present disclosure relates to a method for attaching a firearm barrel to a firearm that has an upper receiver and a rail system. The method includes connecting the firearm barrel to a barrel extension, connecting the barrel extension to the firearm upper receiver and connecting the barrel extension to a hand guard assembly.

In yet further aspects, the present disclosure relates to a method for attaching a firearm barrel to a firearm that has an upper receiver and a hand guard assembly. The method includes attaching a barrel extension about the barrel, positioning the barrel extension in between the upper receiver and the hand guard assembly, attaching the barrel extension to the upper receiver and the hand guard assembly by positioning clamping screws through apertures of the hand guard assembly and apertures of the barrel extension to the upper receiver and securing and locking the clamping screws through the hand guard assembly and barrel extension to the upper receiver.

In still further aspects, the present disclosure relates to an extender for mounting a firearm upper receiver and a firearm barrel with respect to each other with at least one fastener. The firearm upper receiver includes an aperture extending from a forward end. The firearm barrel includes a connection surface extending from a rearward end. The extender includes a support body that has a longitudinal axis extending between a forward section and a rearward section. The forward section has a greater length along the longitudinal axis than the rearward section. The support body is defined by a hollow inner passage. The support body rearward section is configured to insert into and engage within the firearm upper receiver aperture. The support body forward section includes an inner connection surface that is configured to connect with the firearm barrel connection surface. The extender also includes a flange that is fixedly disposed around the support body at a position along the longitudinal axis between the forward section and the rearward section. The flange includes at least one aperture through which the at least one firearm fastener extends. The at least one flange aperture is positioned radially away from the support body.

Other features and aspects of the systems and methods for mounting a barrel to a firearm will be apparent or will become apparent to one with skill in the art upon examination of the following figures and the detailed description. All other features and aspects, as well as other system, method, and assembly embodiments, are intended to be included within the description and are intended to be within the scope of the accompanying claims.

BRIEF DESCRIPTION OF THE DRAWINGS

The detailed description is set forth with reference to the accompanying drawings. The use of the same reference numerals may indicate similar or identical items. Various embodiments may utilize elements and/or components other than those illustrated in the drawings, and some elements and/or components may not be present in various embodiments. Elements and/or components in the figures are not necessarily drawn to scale. Throughout this disclosure, depending on the context, singular and plural terminology may be used interchangeably.

DETAILED DESCRIPTION

Overview

Figure 1:
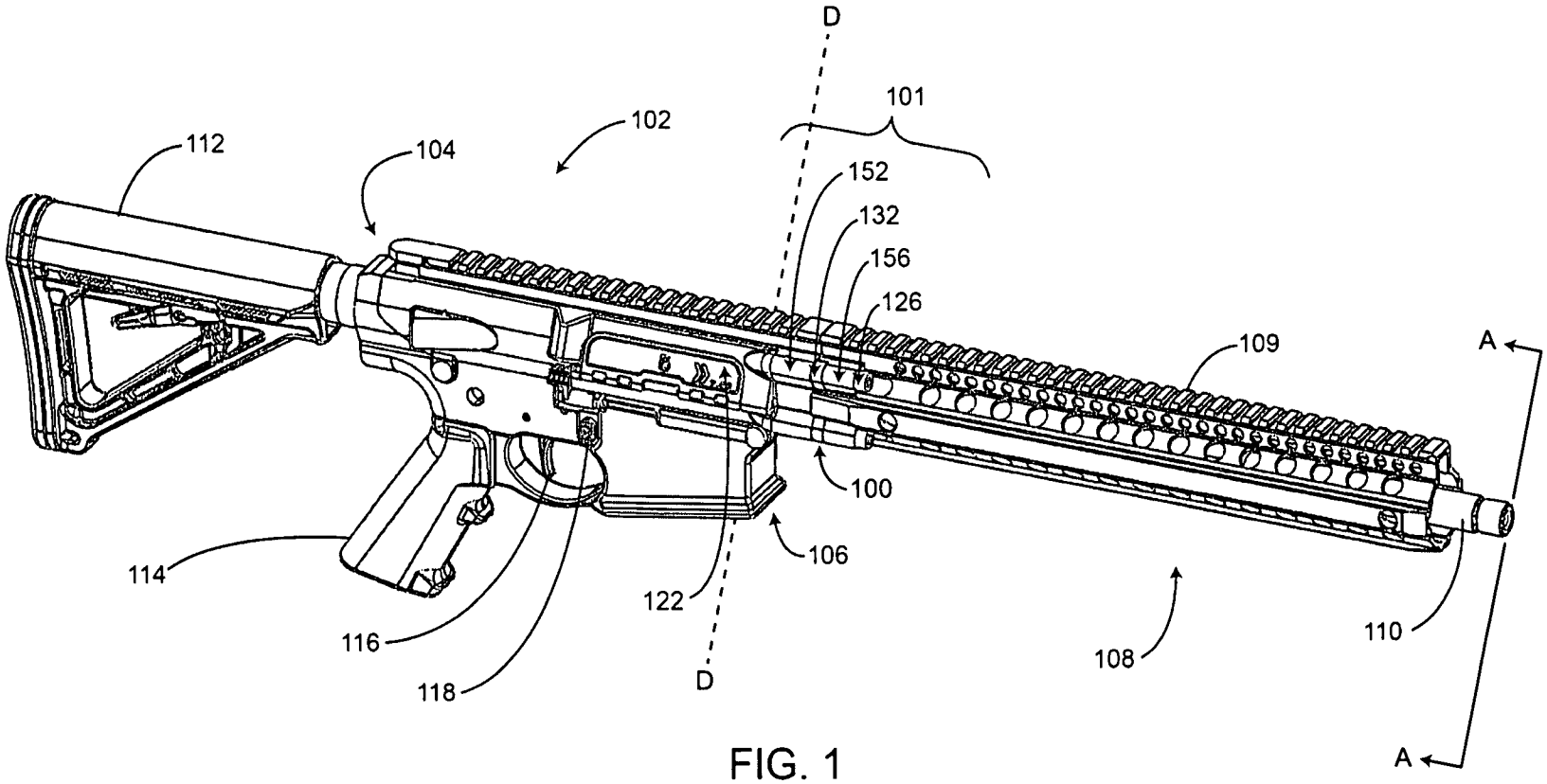
FIG. 1 schematically depicts a right side upper perspective view of a fully assembled firearm in accordance with one or more embodiments of the disclosure.

Described below are embodiments of a barrel mounting system for firearms having a barrel extension, as well as individual components of a firearm, for use in connection with the barrel extension. Methods of attaching the barrel extension on the firearm are also disclosed. The firearm may be a conventional firearm. For example, the firearm may be an M-16 style rifle, an AR-15 style rifle, an AR-10 style rifle, or an M4 style rifle, among others. In relation to conventional firearms, the barrel mounting system for firearms and methods of attachment associated therewith: (1) provides more surface area on the barrel extension, which in turn improves firearm rigidity; (2) utilizes fewer components; and (3) involves easy installation and disassembly in the field by the user (for cleaning, and maintenance or replacement).

Generally speaking, the barrel mounting system can include a barrel assembly that has a barrel, a barrel extension, a gas tube and a gas block. The barrel mounting system can also have a specially machined upper receiver and a hand guard assembly. In certain embodiments, the barrel mounting system can include a protruding threaded barrel extension with mounting apertures, a modified upper receiver with threaded receiving mounting apertures and a hand guard with mounting apertures and large clamping screws. A first end of the upper receiver can be configured to include receiving apertures. For example, the barrel assembly can become the main structure, with the barrel extension positioned between the upper receiver and the hand guard assembly, thereby creating more overall rigidity of the firearm. In some instances, the upper receiver can be modified to have a gas tube aperture, varying in size, to allow installation of different sized gas tubes.

The barrel extension can include a fixed, evenly spaced bolt pattern having apertures disposed on mounting protrusions of the barrel extension. The barrel extension can be tapered to facilitate a more secure fit in between the upper receiver and the hand guard assembly. Additionally, the barrel extension can include internal threads, on the inside front portion of the barrel extension, that correspond to external threads on the barrel. In this manner, the barrel can be screwed into the barrel extension's internal threads. The barrel extension can also include increased surface areas on both the front and the rear section of the barrel extension. The increased surface area of the barrel extension creates a more robust and sturdy connection to the upper receiver and the hand guard assembly—as compared to a conventional firearm design.

The hand guard assembly can include a fixed, evenly spaced bolt pattern having apertures disposed on mounting protrusions of the hand guard assembly. The upper receiver may include a fixed evenly spaced bolt pattern having receiving and/or threaded apertures disposed on the mounting protrusions of the upper receiver. The fixed evenly spaced bolt pattern design on the hand guard assembly and the upper receiver allows a user to secure the barrel extension through the hand guard assembly to the upper receiver via clamping screws.

The hand guard assembly, the barrel extension and the upper receiver may all be tapered to allow the hand guard assembly, the barrel extension, and the upper receiver to mate tightly together—to increase rigidity and stability of the overall rifle. The increase in rigidity and barrel support of the firearm thereby results in increased firing accuracy of the rifle. By way of example, the hand guard assembly may include, but is not limited to, various mounting platforms disposed thereon, such as Mil-Std-1913 (e.g., Picatinny) style rail systems. Weaver style rail systems, Key-Mod style mounting systems, direct attach mounting systems, slot mounting systems, and other similar mounting systems.

These and other embodiments of the disclosure will be described in more detail, through reference to the accompanying drawings, in the detailed description of the disclosure that follows. This brief introduction, including section titles and corresponding summaries, is provided for the reader's convenience and is not intended to limit the scope of the claims or the proceeding sections. Furthermore, the techniques described above and below may be implemented in a number of ways and in a number of contexts. Several example implementations and contexts are provided with reference to the following figures, as described below in more detail. However, the following implementations and contexts are but a few of many.

Illustrative Embodiments

FIGS. 1-11 schematically depict an example barrel mounting system 101 for a firearm 102. The example barrel mounting system 101 includes an example barrel extension 100 and individual components of the firearm 102 for use in connection with the barrel extension 100. Specifically, FIG. 1 schematically depicts the example barrel mounting system 101, the example barrel extension 100, a hand guard assembly 108 and an upper receiver 104. The barrel extension 100 is an essential component in the operation of the firearm 102 and is located at the breech end of the barrel 110. The example barrel extension 100 is positioned and secured between the hand guard assembly 108 and the upper receiver 104, and is secured to the upper receiver 104 via fasteners, for example clamping screws 126.

The example firearm 102 has a barrel 110, a lower receiver 106, the upper receiver 104, the hand guard assembly 108, a buttstock 112, a pistol grip 114, and a trigger 116 attached thereto. The example firearm 102 may be a conventional firearm. By way of example, the firearm 102 may be any number of firearms, such as, but not limited to, an M-16 style rifle, an AR-15 style rifle, an AR-10 style rifle, or an M4 style rifle, or the like. Moreover, the firearm 102 may be a handgun or the like. By way of example, the hand guard assembly 108 may include, but is not limited to, various mounting platforms, such as Mil-Std-1913 (e.g., Picatinny) style rail systems, Weaver style rail systems, Key-Mod style mounting systems, direct attach mounting systems, slot mounting systems, and other similar mounting systems.

As depicted in FIG. 1, the firearm 102 can generally include the upper receiver 104 and the lower receiver 106. The upper receiver 104 generally houses internal components of the firearm 102. The lower receiver 106 generally houses the trigger 116 and a magazine release 118, and has a pistol grip 114 attached to the lower receiver 106 for normal operational use of the firearm 102. The firearm 102 generally includes the hand guard assembly 108 positioned at least partially about the barrel 110. The barrel 110 includes external barrel threads 130, which are preferably screwed into barrel extension internal threads 148 of the barrel extension 100. The barrel 110 extends from the upper receiver 104 along a longitudinal axis and is secured or otherwise mounted to the upper receiver 104 using, for example, the barrel extension 100 and the clamping screws 126. The barrel extension 100 may also extend through the hand guard assembly 108 to the upper receiver 104 and may be secured or otherwise mounted to the upper receiver 104 via the clamping screws 126. In some instances, the hand guard assembly 108 may include rails 109 or the like as described herein. The rails 109 may be configured to attach a number of accessories to the hand guard assembly 108. Additionally, the firearm 102 may have an ejection port 120 with an associated ejection port cover 122, wherein the spent firearm casings are expelled from within the firearm 102.

Figure 2:
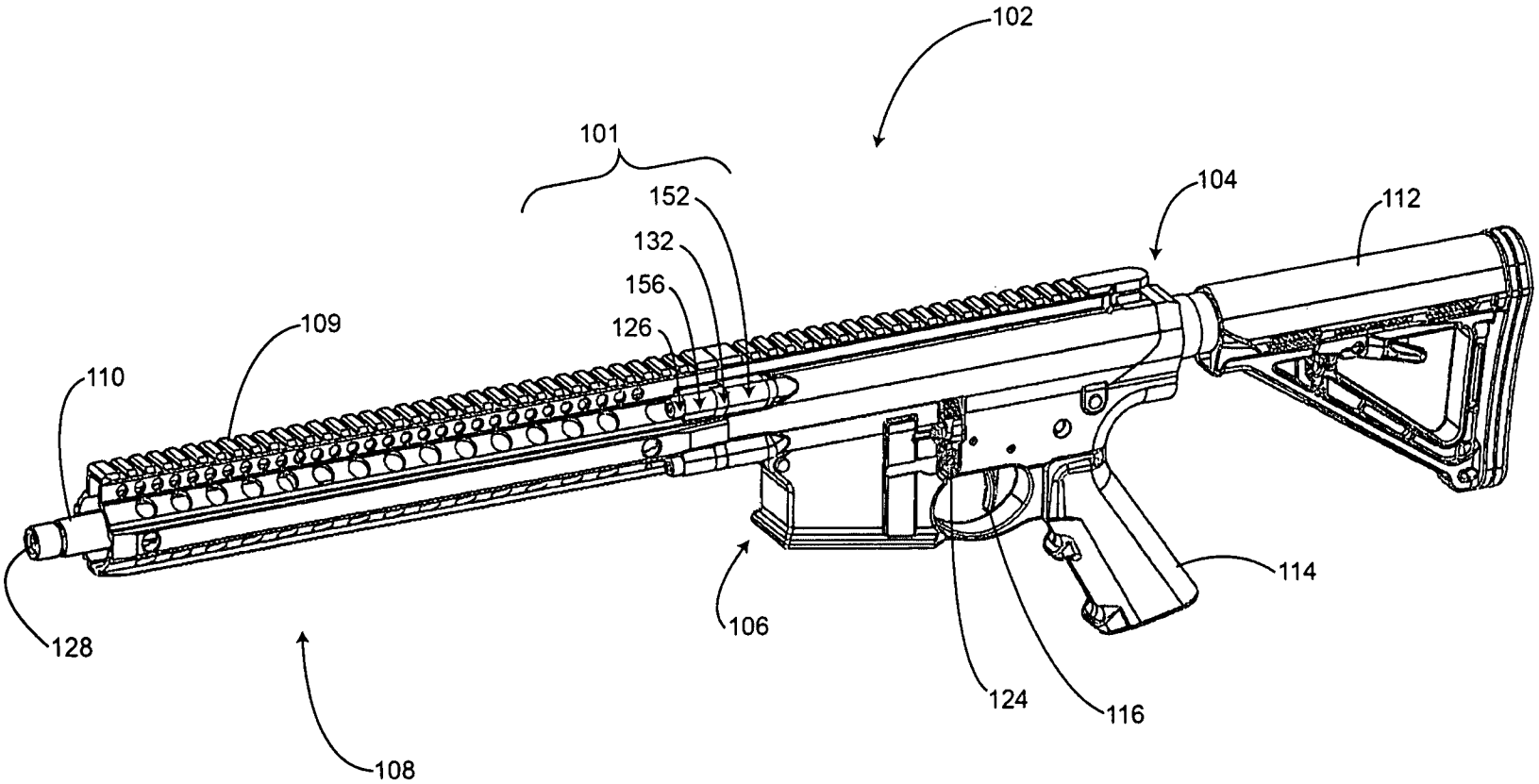
FIG. 2 schematically depicts a left side upper perspective view of the fully assembled firearm shown in FIG. 1.

FIG. 2 schematically depicts a left side upper perspective view of a fully assembled firearm 102, in accordance with one or more embodiments of the disclosure. Additionally, the firearm 102 has a bolt catch 124 disposed within the lower receiver 106, wherein the bolt catch 124 catches a firearm bolt (not shown) when the last firearm casing is spent. In all embodiments, the firearm 102 includes a barrel 110 and a barrel bore 128. As noted above, the barrel 110 may extend from the upper receiver 104 along a longitudinal axis and may be secured or otherwise mounted to the upper receiver 104 through the barrel extension 100. The barrel bore 128 may extend through the center of the barrel 110 along the longitudinal axis.

Figure 3:
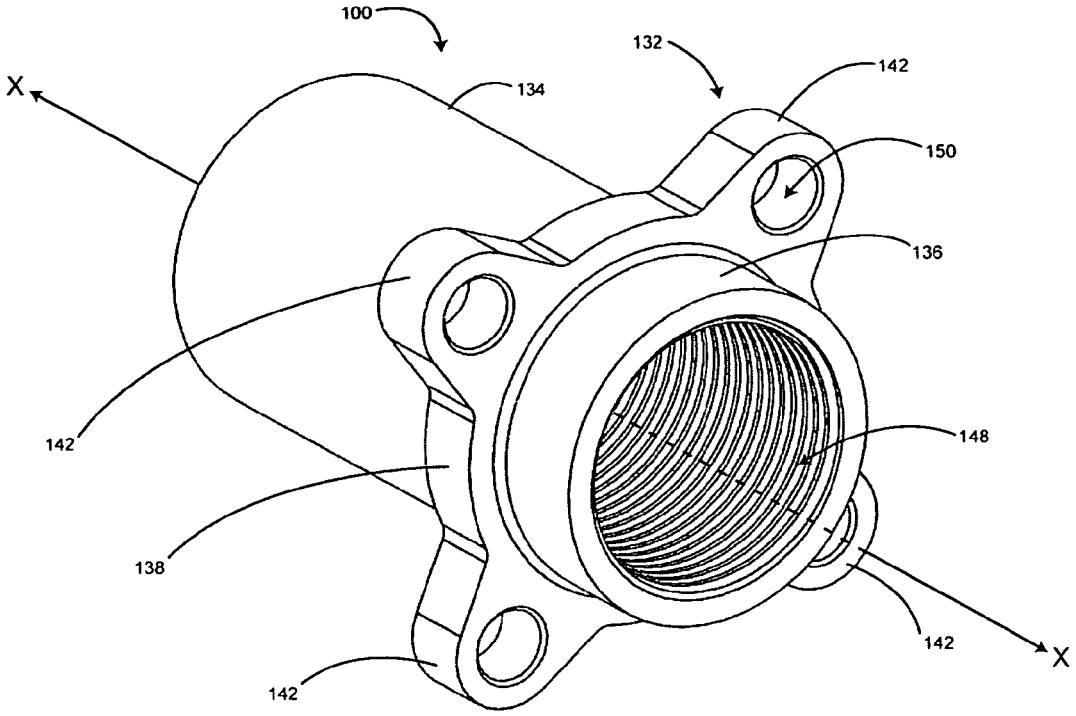
FIG. 3 schematically depicts a front right upper perspective view of a barrel extension in accordance with one or more embodiments of the disclosure, shown isolated from the fully assembled firearm shown in FIG. 1.

FIG. 3 schematically depicts a front right upper perspective view of the example barrel extension 100, in accordance with one or more embodiments of the disclosure. The depicted barrel extension 100 can generally include barrel extension mounting protrusions 142, and a body with a longitudinal axis X extending between an elongated and protruding front barrel extension section 136 and an elongated and protruding rear barrel extension section 134. As depicted, the elongated front barrel extension section 136 can extend a greater length than the elongated rear barrel extension section 134 along the longitudinal axis X. The barrel extension mounting portion 132 can include a barrel extension mounting flange 138 that supports the barrel extension mounting protrusions 142 positioned radially outward away from the barrel extension 100. The barrel extension mounting portion 132 can be fixed to the barrel extension 100 on the body, at a position between the front section 136 and the rear section 134. The barrel extension mounting protrusions 142 can have barrel extension mounting receivers or apertures 150 disposed therethrough. The depicted barrel extension mounting protrusions 142 can be tapered to ensure a more secure fit with the upper receiver 104 and the hand guard assembly 108. The elongated and protruding front barrel extension section 136 and the elongated and protruding rear barrel section 134 provide a greater surface area when sandwiched and secured in between the upper receiver 104 and the hand guard assembly 108, and secured via the clamping screws 126. The depicted barrel extension 100 can form a monolithic structure including the front barrel extension section 136, the rear barrel section 134 and the mounting flange 138 with the mounting protrusions 142.

The example barrel extension 100 can have barrel extension internal threads 148 that correspond to the external barrel threads 130 on the barrel 110. In this manner, the barrel 110 can be screwed directly into the barrel extension 100. Other attachment configurations between the barrel extension 100 and the barrel 110 are also possible including, but not limited to, welding, pressure fitting, snapping-on, bolting, etc.

Figure 4:
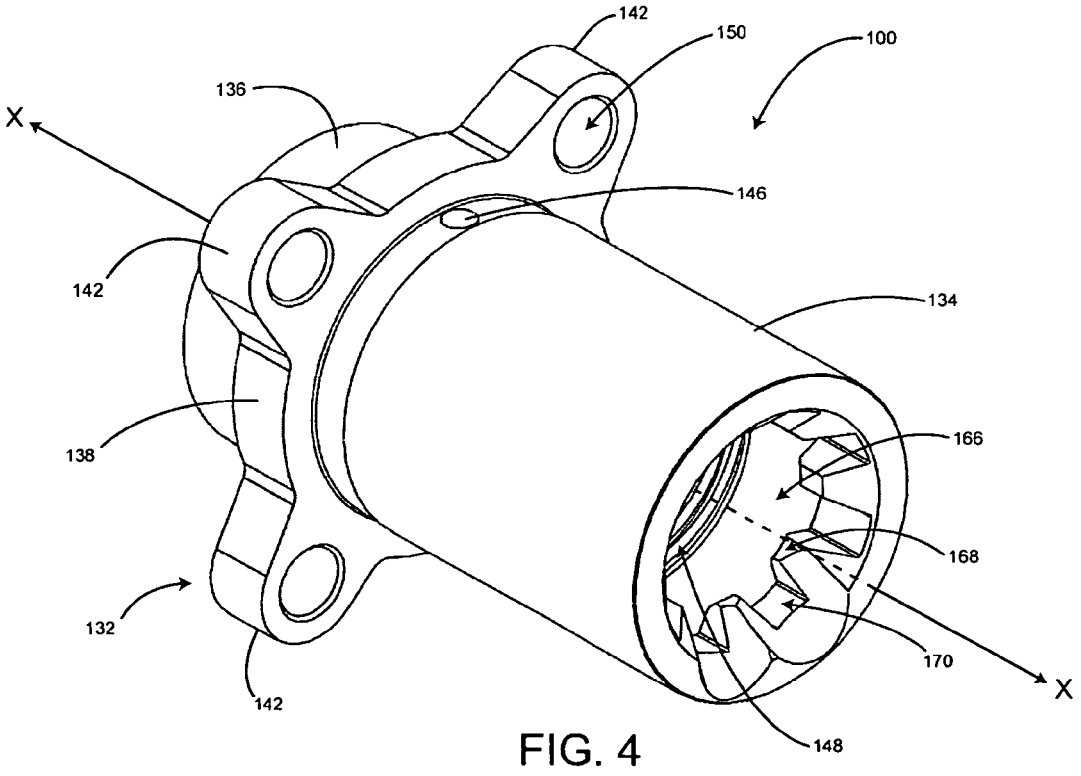
FIG. 4 schematically depicts a rear left upper perspective view of the barrel extension shown in FIG. 3.

FIG. 4 schematically depicts a rear left upper perspective view of the barrel extension 100, in accordance with one or more embodiments of the disclosure. The barrel extension 100 shows an annular bolt recess 166, locking lugs 168, and cartridge feed ramps 170. A bolt carrier group (not shown), according to technology understood by a person of ordinary skill in the art, works in concert with the barrel extension 100 to either push a fresh bullet into the firearm chamber or remove an empty bullet cartridge from the firearm chamber (not shown) through the annular bolt recess 166, as would be understood by a person or ordinary skill in the art. Specifically, a bolt (not shown) on the bolt carrier group (not shown) is guided into place through the cartridge feed ramps 170 and is locked in via the locking lugs 168, as would be understood by a person or ordinary skill in the art. Once the bolt carrier group moves back to the rear of the firearm 102, the bolt turns and unlocks from the barrel extension 100. The cycle restarts and repeats.

The depicted barrel extension 100 can also have a barrel indexing pin 146. The barrel indexing pin 146 is a protrusion that fits into a receiver in the upper receiver 104 to ensure proper installation by a user. The barrel indexing pin 146 can resistively flex into the barrel extension during installation, then return to a rest state once aligned with the upper receiver 104.

Figure 5:
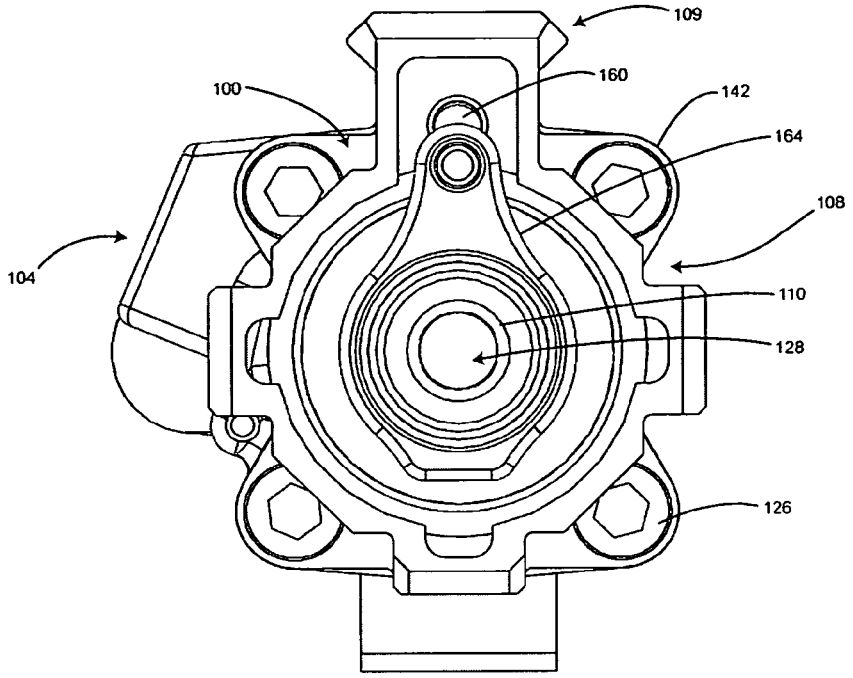
FIG. 5 schematically depicts a front view of the barrel and barrel mounting system isolated from the fully assembled firearm shown in FIG. 1, as viewed along sightline A and terminating at line D.

FIG. 5 schematically depicts a front view of the barrel mounting system 101, in accordance with one or more embodiments of the disclosure. The hand guard assembly 108 is secured to the upper receiver 104 through the barrel extension 100 via the clamping screws 126. As shown in FIG. 5, the user can easily secure and unsecure the barrel extension 100 from the firearm 102 in the field, for changing parts and/or for maintenance.

A gas tube 160 can be connected to the bolt carrier group (not shown) and disposed in the upper receiver 104, through the hand guard assembly 108, to the gas block 164. The gas block 164 may be positioned about the barrel 110 of the firearm 102, or along the longitudinal length of the barrel 110. For example, the gas block 164 may be positioned about the barrel 110 at any location in between the upper receiver 104 and the muzzle end of the firearm 102. In certain embodiments, the gas block 164 may be attached to the barrel 110 by any means known in the art, such as, but not limited to, welding, screwing, bolting, pressure fitting, etc. In the preferred embodiment, the gas block 164 is disposed within the hand guard assembly 108. However, the hand guard assembly 108 can vary in size and length which may result in the gas block 164 being disposed on the exterior of the hand guard assembly 108 (i.e., further down the barrel 110 on the outside of the hand guard assembly 108).

Figure 6:
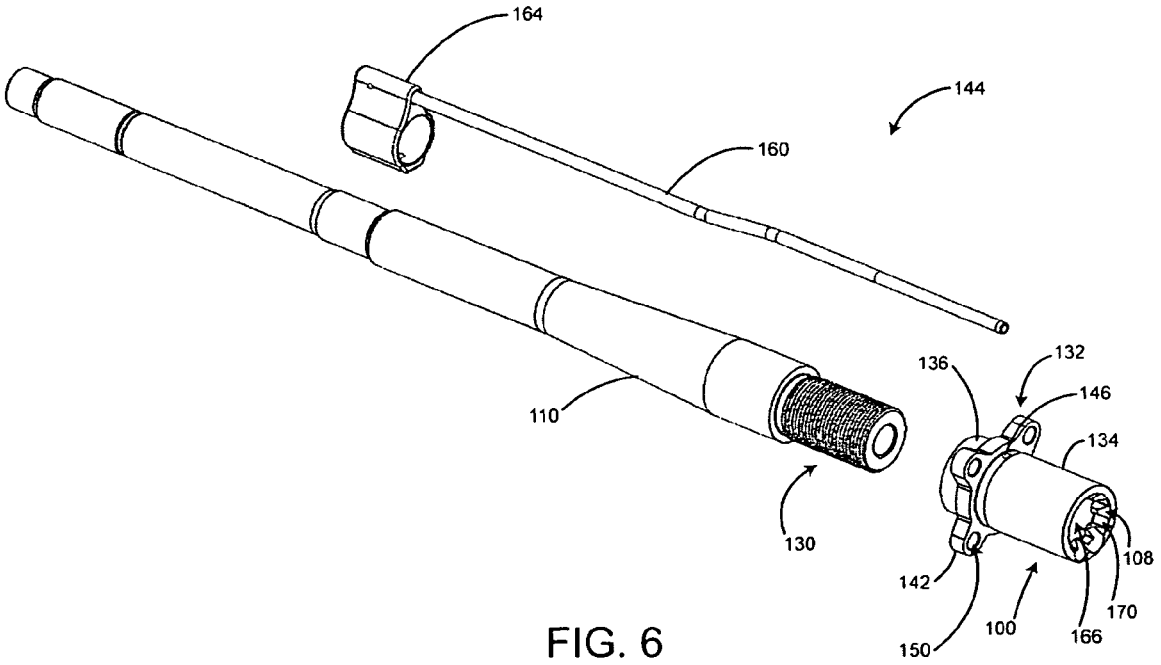
FIG. 6 schematically depicts an exploded rear left upper perspective view of the barrel assembly shown in FIG. 5.

FIG. 6 schematically depicts a rear left upper perspective view of a disassembled barrel assembly 144, in accordance with one or more embodiments of the disclosure. The barrel assembly 144 includes the barrel 110, the gas block 164, the barrel extension 100, and the gas tube 160. The barrel extension 100 is secured to the barrel 110 by the user utilizing the external barrel threads 130 of the barrel 110 and screwing the barrel 110 into the corresponding barrel extension internal threads 148 of the barrel extension 100.

Figure 7:
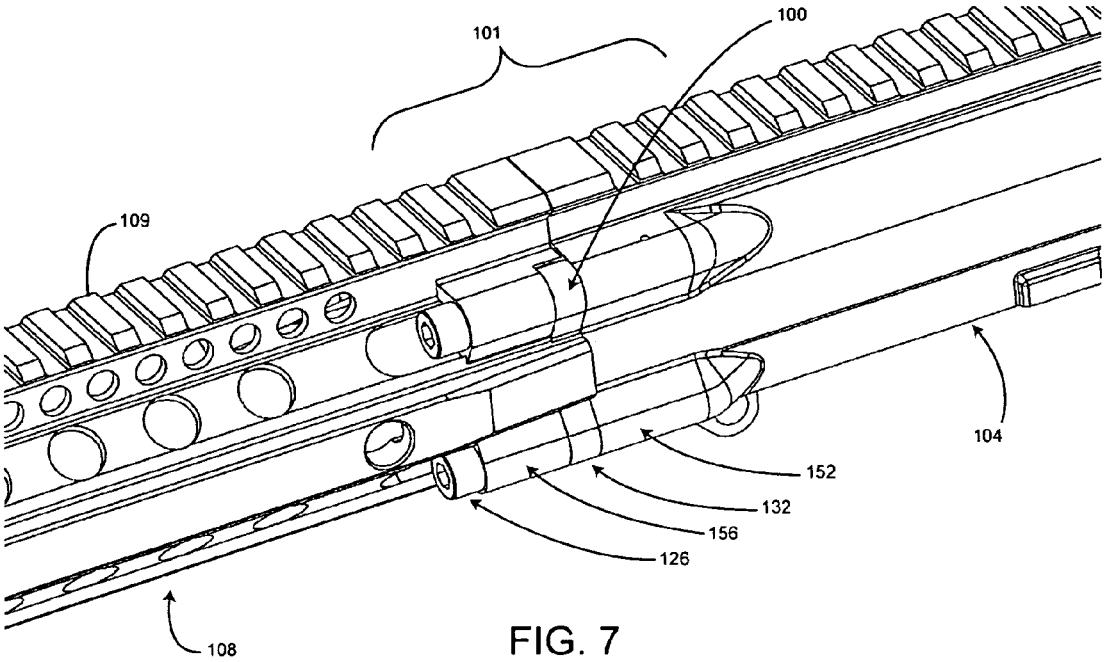
FIG. 7 schematically depicts an enlarged left side upper perspective view of the barrel mounting system of the fully assembled firearm shown in FIG. 1, showing the hand guard assembly secured to the upper receiver with the barrel extension.

FIG. 7 schematically depicts a close-up left side upper perspective view of the fully assembled barrel mounting system 101, in accordance with one or more embodiments of the disclosure. The hand guard assembly 108 and the upper receiver 104 are connected together through the barrel extension 100 via fasteners, for example the clamping screws 126. Specifically, the clamping screws 126 are first placed through apertures (not shown) in the hand guard mounting portion of the hand guard assembly 108. Thereafter, the clamping screws 126 continually travel through apertures on the barrel extension mounting protrusions 142 of the barrel extension 100. Finally, the clamping screws 126 are screwed into internal threads in the apertures of the upper receiver mounting portion 152 of the upper receiver 104. Securing the barrel extension 100 to the hand guard assembly 108 and to the upper receiver 104 provides an extremely stable connection for the user. The stable connection results in improved rigidity and accuracy for a user of the firearm 102. As shown in FIG. 7, the barrel extension mounting portion 132 sits flush in between the hand guard assembly mounting portion 156 and the upper receiver mounting portion 152. The barrel extension 100 can be tapered to further increase the stability of the overall connection.

Figure 8:
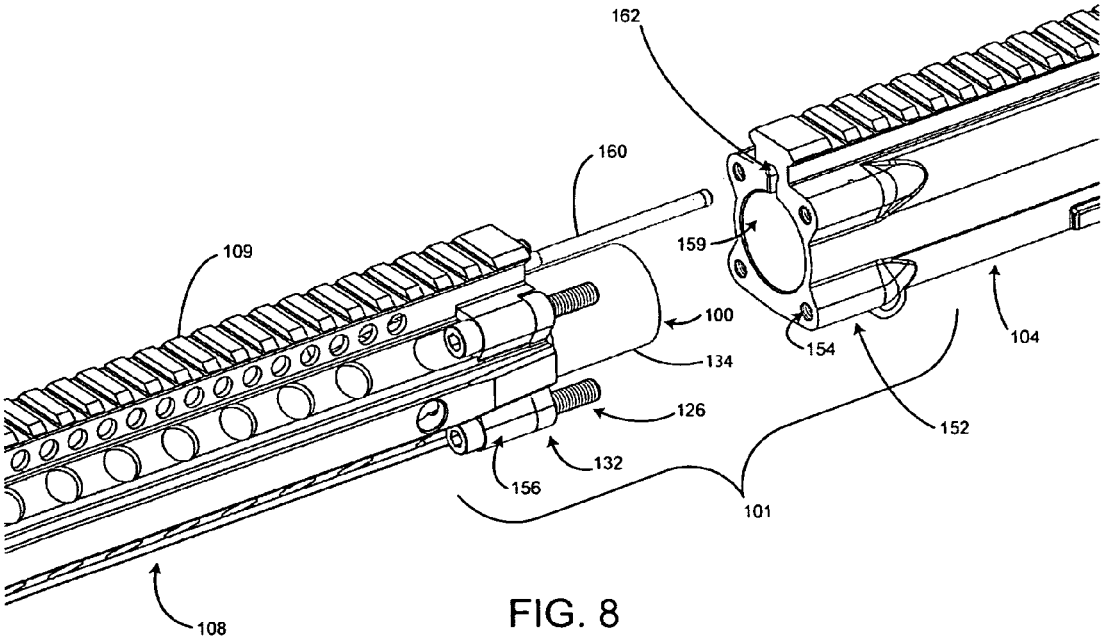
FIG. 8 schematically depicts an enlarged left side upper perspective view of the barrel mounting system shown in FIG. 7, showing the hand guard assembly detached from the upper receiver and the barrel extension.

FIG. 8 schematically depicts a left side upper perspective view of the partially assembled barrel mounting system 101 secured to the hand guard assembly 108 and detached from the upper receiver 104. The barrel extension 100 is connected to the hand guard assembly 108 through the clamping screws 126 and to the upper receiver 104 in upper receiver mounting apertures 154. The upper receiver mounting apertures 154 are preferably threaded to allow a more stable connection with the clamping screws 126. Other connection means are contemplated such as push buttons, ball detents, etc. FIG. 8. shows that elongated rear barrel extension section 134 fits into the upper receiver barrel extension large aperture 159 of the upper receiver 104. The elongated rear barrel extension section 134 allows for increased rigidity of the firearm 102. The gas tube 160 is secured to the gas block 164 (not shown) through the hand guard assembly 108. The upper receiver 104 has an upper receiver gas tube aperture for acceptance of the gas tube 160. The secure fit of the gas tube 160 into the upper receiver gas tube aperture 162 allows for increased stability of the firearm 102.

Figure 9:
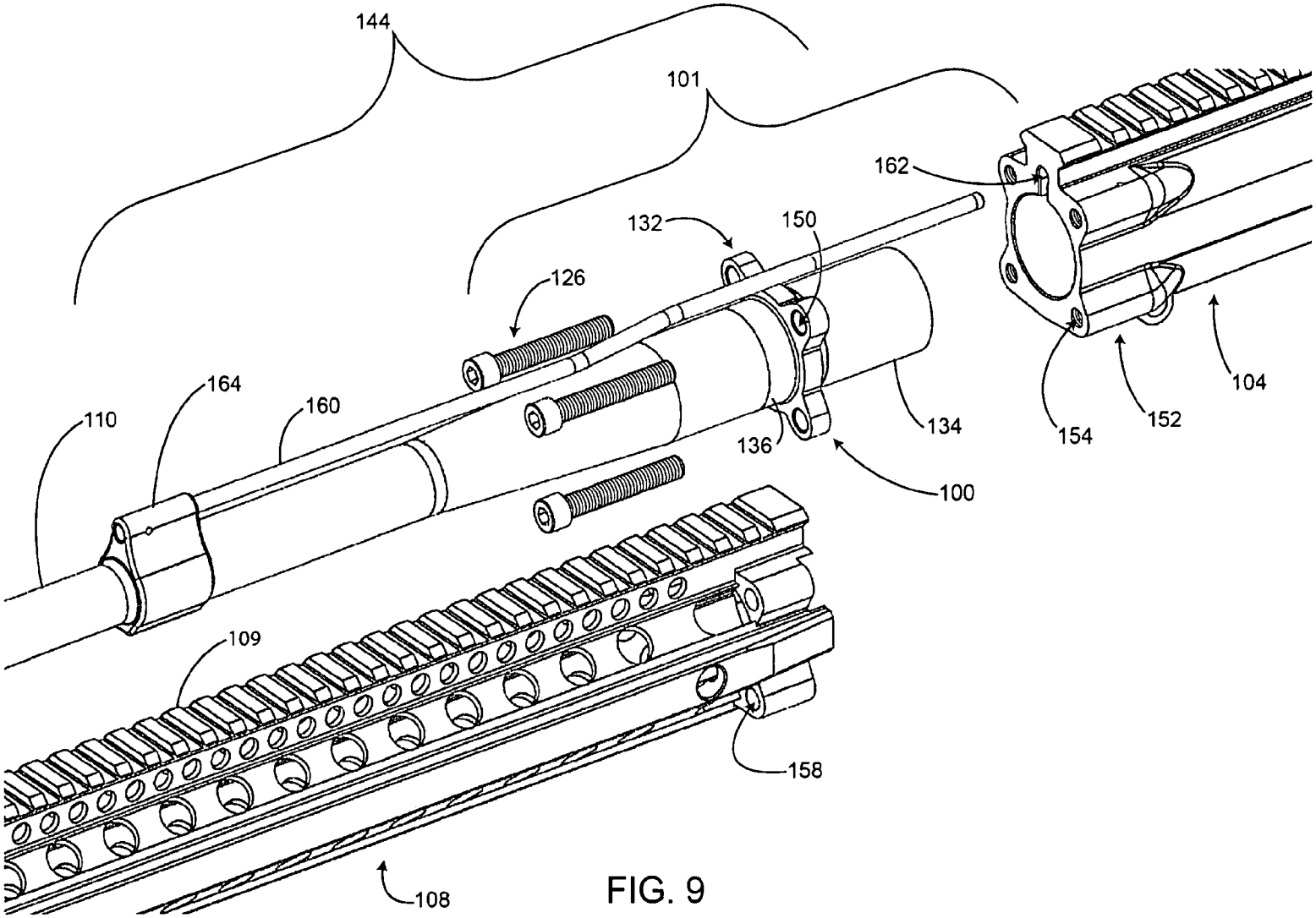
FIG. 9 schematically depicts an enlarged left side upper perspective view of the barrel mounting system shown in FIGS. 7 and 8, showing the hand guard assembly detached from the upper receiver and the barrel extension and the barrel removed from the upper receiver and the barrel extension.

FIG. 9 schematically depicts a left side upper perspective view of a disassembled barrel mounting system 101, in accordance with one or more embodiments of the disclosure. The barrel assembly 144 includes the barrel 110, the gas block 164, the barrel extension 100, and the gas tube 160. The barrel extension 100 further includes the elongated front barrel extension section 136. The elongated front barrel extension section 136 allows for a more surface area connection with the hand guard assembly 108 and the barrel 110—thereby increasing overall rigidity of the firearm 102. The hand guard assembly 108 may include the hand guard assembly mounting apertures 158, through which the user places the clamping screws 126 for mounting the barrel extension 100 into the upper receiver 104.

Figure 10:
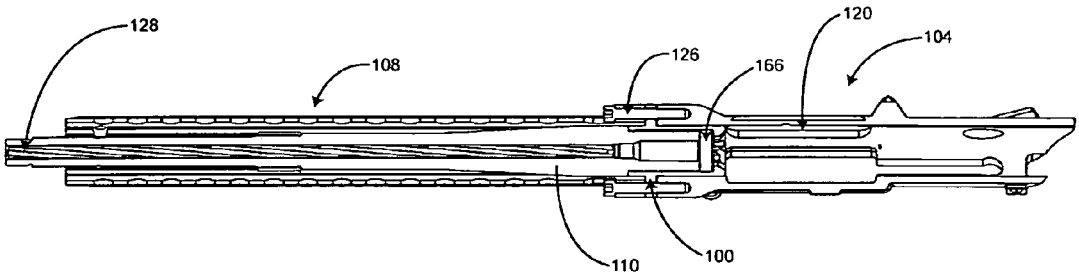
FIG. 10 schematically depicts an underneath cross sectional view of the fully assembled barrel mounting system shown in FIG. 7.

FIG. 10 schematically depicts a bottom cross sectional view of the fully assembled barrel mounting system 101, in accordance with one or more embodiments of the disclosure. The hand guard assembly 108 is connected to the barrel extension 100 and the upper receiver 104 via clamping screws 126. FIG. 10 shows the barrel 110 fully screwed into the barrel extension 100. The barrel extension 100 has an annular bolt recess 166, locking lugs 168, and cartridge feed ramps 170 (as depicted in FIG. 4), which allows the firearm casing placement and displacement via the bolt carrier group (not shown). The upper receiver 104 depicts the ejection port 120 with the associated ejection port cover 122 (as depicted in FIG. 1) wherein spent firearm casings are expelled from the firearm 102.

Figure 11:
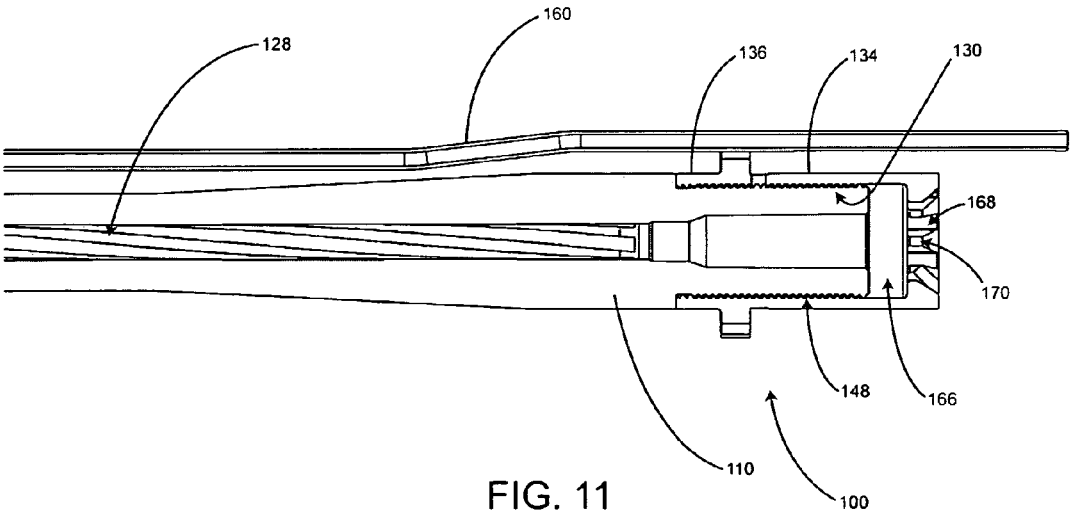
FIG. 11 schematically depicts an enlarged left side cross sectional view of the barrel assembly isolated from the fully assembled barrel mounting system shown in FIG. 7.

FIG. 11 schematically depicts a close-up left side cross sectional view of the barrel assembly 144, in accordance with one or more embodiments of the disclosure. The barrel 110, having external barrel threads 130, is thereafter screwed into the barrel extension 100 via the barrel extension internal threads 148. Furthermore, FIG. 11 shows the interface between the gas tube 160 and the barrel extension 100.

Illustrative Methods

Figure 12:
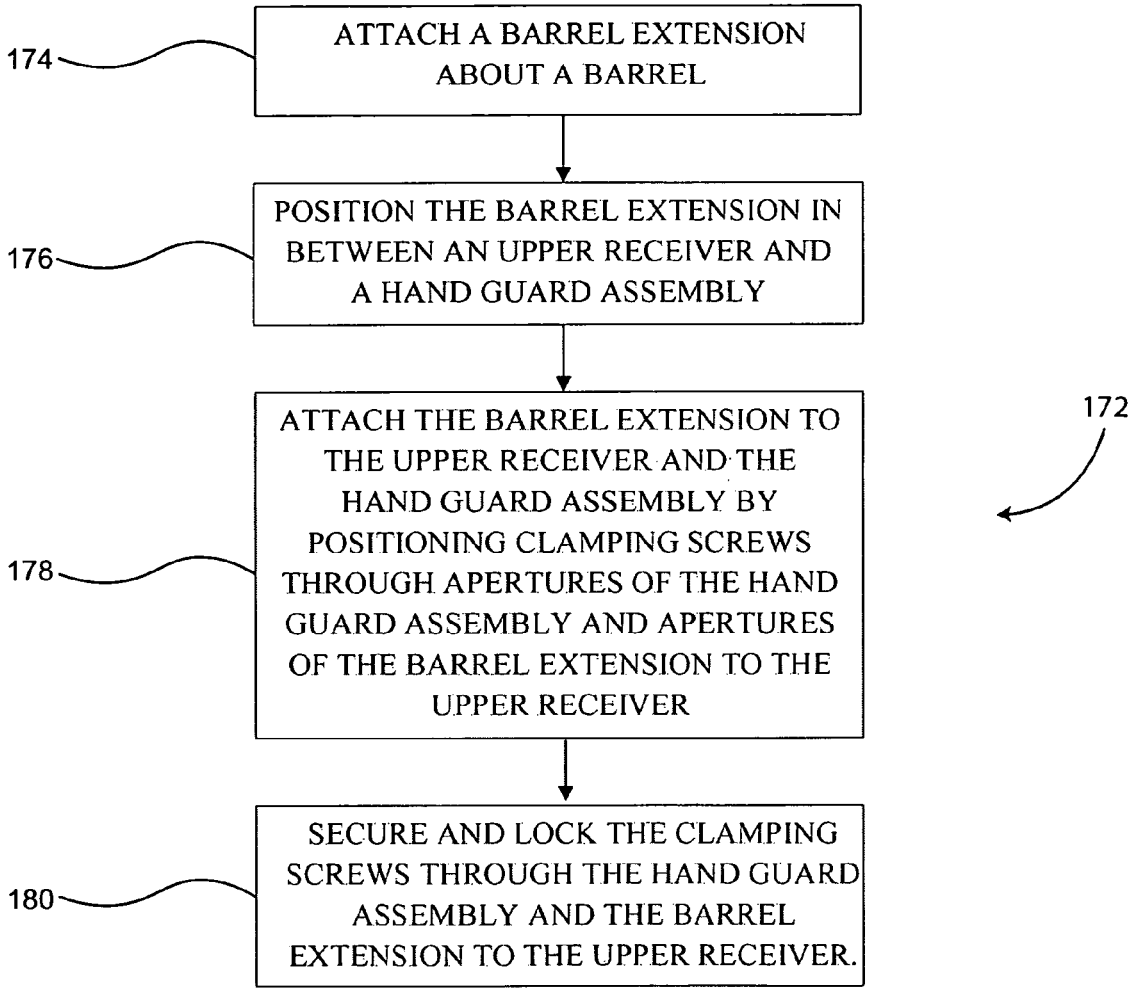
FIG. 12 is a flow diagram depicting an illustrative method for attaching a barrel extension to a firearm upper receiver and hand guard assembly in accordance with one or more embodiments of the disclosure.

FIG. 12 is a flow diagram depicting an illustrative method 172 for attaching the barrel extension 100 to the upper receiver 104 and the hand guard assembly 108, in accordance with one or more embodiments of the disclosure.

At block 174 of method 172, the barrel extension 100 can be attached about the barrel 110. For example, the barrel extension 100 can be positioned and screwed around the barrel 110 through the barrel extension internal threads 148 by a user. At block 176 of the method 172, the barrel extension 100 can be positioned between the upper receiver 104 and the hand guard assembly 108. That is, upon positioning the barrel 110 around the barrel extension 100, the user can position the barrel extension 100 directly in between the upper receiver 104 and the hand guard assembly 108. In some instances, the hand guard assembly 108 can be positioned over the barrel 110 onto the barrel extension 100. In other instances, the hand guard assembly 108 is composed of more than one member and is clamped and secured around the barrel extension 100. Other methods of attachment are contemplated to those known in the art. For example, at block 178 of method 172, the user can attach the hand guard assembly 108 (through the barrel extension 100) to the upper receiver 104 by placing and positioning the clamping screws 126 through the hand guard assembly mounting apertures 158 and further through the barrel extension mounting apertures 150 into the upper receiver mounting apertures 154. At block 180 of method 172, the user can secure and lock the clamping screws 126 through the hand guard assembly 108 and the barrel extension 100 into the upper receiver 104.

Although specific embodiments of the disclosure have been described, numerous other modifications and alternative embodiments are within the scope of the disclosure. For example, any of the functionality described with respect to a particular device or component may be performed by another device or component. Further, while specific device characteristics have been described, embodiments of the disclosure may relate to numerous other device characteristics. Further, although embodiments have been described in language specific to structural features and/or methodological acts, it is to be understood that the disclosure is not necessarily limited to the specific features or acts described. Rather, the specific features and acts are disclosed as illustrative forms of implementing the embodiments. Conditional language, such as, among others, "can," "could," "might," or "may," unless specifically stated otherwise, or otherwise understood within the context as used, is generally intended to convey that certain embodiments could include, while other embodiments may not include, certain features, elements, and/or steps. Thus, such conditional language is not generally intended to imply that features, elements, and/or steps are in any way required for one or more embodiments.

We claim:

1. A barrel mounting system for a firearm, the firearm having a barrel, an upper receiver having a distal end and a hand guard assembly having a proximal end, the barrel mounting system comprising:

an upper receiver mounting portion disposed distally upon the firearm upper receiver;

a hand guard assembly mounting portion disposed proximally on the hand guard assembly; and a firearm barrel extension for interconnecting the barrel, the upper receiver, and the hand guard assembly of the firearm, the firearm barrel extension having:

an elongated rear barrel extension section having an interior and an exterior;

an elongated front barrel extension section having an interior and an exterior and the interior having internal threads therein for securement to the barrel;

a barrel extension mounting and attachment flange unitarily formed with the firearm barrel extension between the elongated rear barrel extension section and the elongated front barrel extension section;

the barrel extension mounting flange having exteriorly thereon a plurality of barrel extension mounting protrusions disposed in a radially spaced array; and each barrel extension mounting protrusion having a mounting aperture disposed therein for receiving a threaded mounting screw to join and attach with the upper receiver mounting portion and the hand guard assembly mounting portion.

2. The barrel mounting system of claim 1, wherein the elongated rear barrel extension section has an annular bolt recess disposed therein.

3. The barrel mounting system of claim 1, wherein the elongated rear barrel extension section has a plurality of radially disposed locking lugs thereon for engagement with a bolt carrier group disposed within the upper receiver.

4. The barrel mounting system of claim 3, wherein at least one adjacent pair of the radially disposed locking lugs are separated by a cartridge feed ramp.

5. The barrel mounting system of claim 3, wherein the plurality of radially disposed locking lugs are equidistantly arrayed.

6. The barrel mounting system of claim 1, wherein the plurality of mounting apertures are at least four in number.

7. The barrel mounting system of claim 1, wherein the exterior of the elongated rear barrel extension section is shaped to fit within a matingly shaped aperture at the distal end of the upper receiver.

8. The barrel mounting system of claim 1, wherein the distal end of the upper receiver has a matingly shaped aperture, and the exterior of the elongated rear barrel extension section and the matingly shaped aperture are substantially cylindrical in shape.

9. The barrel mounting system of claim 8, wherein the exterior of the elongated front barrel extension section is shaped to fit within a matingly shaped aperture at the proximal end of the firearm hand guard assembly.

10. The barrel mounting system of claim 9, wherein the exterior of the elongated front barrel extension section and the matingly shaped aperture at the proximal end of the firearm hand guard assembly are substantially cylindrical in shape.

11. The barrel mounting system of claim 1, further comprising a barrel indexing pin disposed in the firearm barrel extension, to engage with a receiver within the upper receiver.

12. A barrel mounting system for a firearm, the firearm having a barrel, an upper receiver having a distal end, and a hand guard assembly having a proximal end, the barrel mounting system comprising:

an upper receiver mounting portion disposed distally on the upper receiver;

a hand guard assembly mounting portion disposed proximally on the hand guard assembly;

a firearm barrel extension for interconnecting the barrel, the upper receiver, and the hand guard assembly of the firearm, the firearm barrel extension having:

a support body having an interior and an exterior;

barrel extension internal threads disposed within the interior of the support body for securement of the barrel extension to the barrel;

a barrel extension mounting and attachment flange unitarily formed on the exterior of the support body and the barrel extension mounting flange comprising a plurality of barrel mounting protrusions disposed in a spaced radial array and the barrel extension mounting protrusions having apertures disposed therein for receiving mounting screws to join and attach the upper receiver mounting portion and the hand guard assembly mounting portion.

* * * * *